US005335529A

United States Patent [19]

Crowdus et al.

[11] Patent Number: 5,335,529

[45] Date of Patent: Aug. 9, 1994

[54] BENDING FIXTURE AND METHOD OF ASSEMBLING THE BENDING FIXTURE

[75] Inventors: Robert A. Crowdus, Mount Clemens, Mich.; Gary L. Knirk, Lexington; John K. Silverson, Richmond, both of Ky.

[73] Assignee: Bundy Corporation, Warren, Mich.

[21] Appl. No.: 894,241

[22] Filed: Jun. 8, 1992

Related U.S. Application Data

[63] Continuation of Ser. No. 670,794, Mar. 18, 1991, abandoned.

[51] Int. Cl.[5] ..... B21D 7/16; B21D 7/00

[52] U.S. Cl. ..... 72/404; 72/447; 72/217; 29/464

[58] Field of Search ..... 72/404, 455, 446–448, 72/705, 306, 217; 269/900; 29/464, 465, 468

[56] References Cited

U.S. PATENT DOCUMENTS

| | | | |
|---|---|---|---|
| 2,366,012 | 12/1944 | Draper | 72/217 |
| 3,440,859 | 4/1969 | Holtzhauer | 72/404 |
| 4,901,990 | 2/1990 | Frechette | 269/900 |
| 4,930,333 | 6/1990 | Marbury | 72/705 |
| 4,972,698 | 11/1990 | Ross | 72/447 |

FOREIGN PATENT DOCUMENTS

| | | | |
|---|---|---|---|
| 200092 | 6/1955 | Australia | 72/404 |

OTHER PUBLICATIONS

"Quick Die Change System" from Brochure by Hilma Corporation of America, Brookfield, Conn., pp. 1–12, Dec., 1987.

*Primary Examiner*—Daniel C. Crane

*Attorney, Agent, or Firm*—Barnes, Kisselle, Raisch, Choate, Whittemore & Hulbert

[57] ABSTRACT

A tube bending fixture having a plurality of tube bending tools, a pedestal for each tube bending tool, a grid plate for supporting each pedestal, and a grid plate support for supporting the grid plates in a predetermined arrangement. The fixture is built from a simulation program of tool selection, tool location and bending sequence. The simulation program is entered into a computer for viewing to insure that the tools are properly selected and properly located to permit operation in the desired sequence without interference. The computer will output a list of the tools needed and a list of coordinates to establish tool location. The bending tools have clamp rolls which are relatively movable between open and closed positions, and when closed define an arcuate groove. A bending roll is provided for bending a tube around the groove.

22 Claims, 7 Drawing Sheets

36
38
40
42
44
46
48
50
52
54
56
58
60
62
64
66
68
70
72
74
20

BENDING FIXTURE AND METHOD OF ASSEMBLING THE BENDING FIXTURE

This is a continuation of copending application Ser. No. 07/670,794 filed on Mar. 18, 1991, now abandoned.

This invention relates generally to tube bending and more particularly to tube bending tools, a tube bending fixture employing a plurality of such tools, and a method and apparatus for making a tube bending fixture.

BACKGROUND

At the present time, tube bending fixtures are made on a "construct as you go" basis. A toolmaker decides on tool orientation and bending sequence, and then the necessary tools are designed and built one tool at a time. The tool for making the second bend is not started until the tool for the first bend is built, or at least designed, and so on. The tools for each fixture are custom made, and then discarded when the fixture is no longer needed.

SUMMARY OF THE INVENTION

It is an object of this invention to provide a tube bending fixture made essentially of a limited variety of standard bending tools which can be made before designing a given fixture and hence be readily available when needed. The toolmaker will begin the design of a bending fixture by conceptualizing or visualizing tool orientation and bending sequence, using a limited variety of standard tools rather than an unlimited number of custom tools. He will then develop a simulation program of tool selection, tool location and bending sequence. Preferably the simulation program is entered into a computer for viewing to insure that the selected standard tools are properly located to permit operation in the desired sequence without interference. Different standard tools and bending sequences may have to be tried and adjustments in tool location made in order to make the fixture interference free. Upon completion of the simulation program, the computer can print out a list of the standard tools needed and a list of coordinates to establish the location of each tool in the fixture.

Another object of the invention is to provide a locating device for locating the various standard tools on the fixture in accordance with the coordinates developed in the simulation program.

A further object is to provide various improvements in the construction of standard bending tools used in the fixture.

Other objects are to provide a tube bending fixture having tube bending tools which are of essentially standard construction, which is rugged and dependable, composed of a relatively few simple parts and capable of being rapidly, readily and inexpensively designed and manufactured.

BRIEF DESCRIPTION OF THE DRAWINGS

These and other objects, features and advantages of the invention will become more apparent as the following description proceeds, especially when considered with the accompanying drawings, wherein.

DETAILED DESCRIPTION

Figure 1:
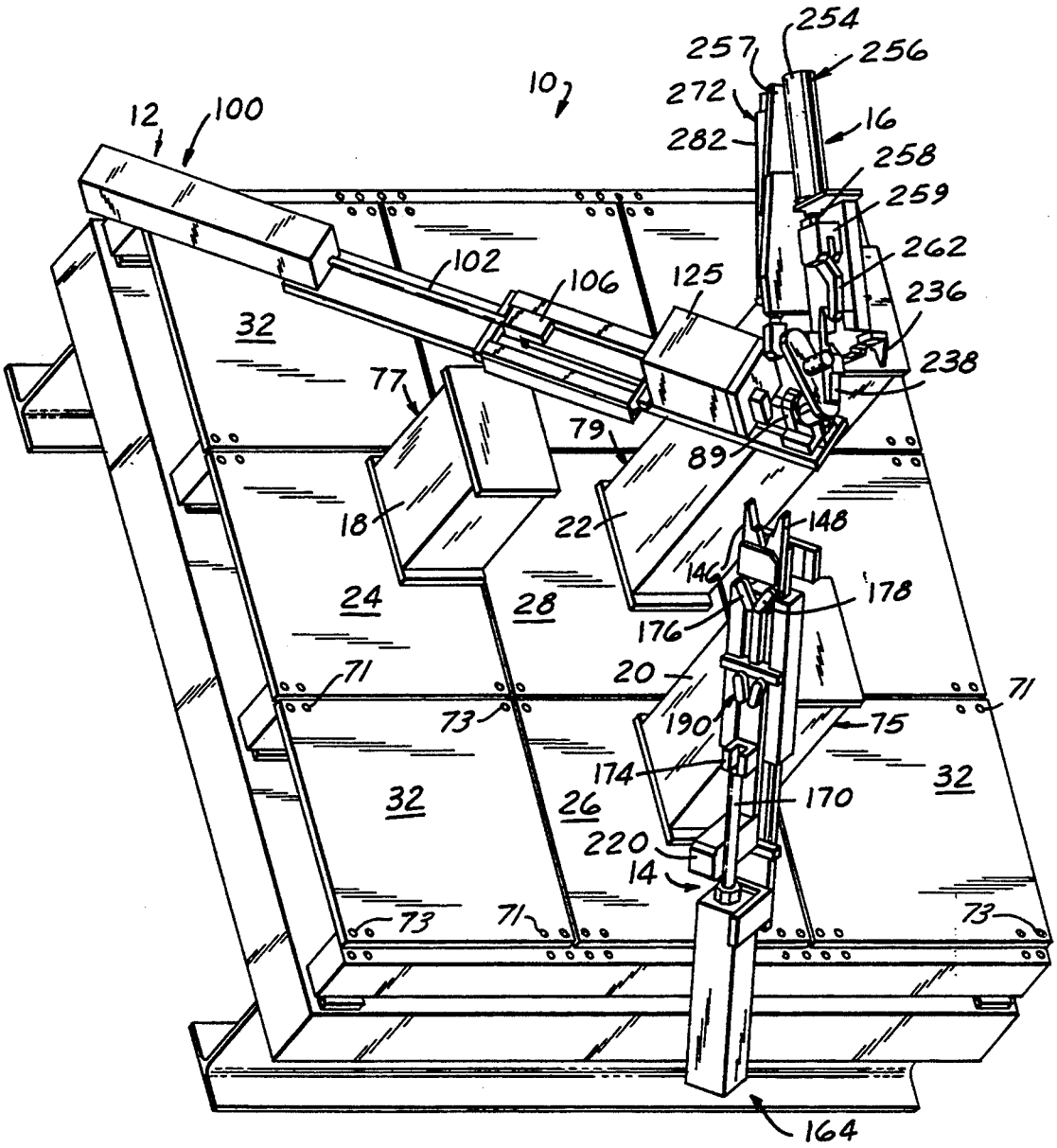
FIG. 1 is a perspective view of a tube bending fixture constructed in accordance with the invention, having standard tube bending tools which are shown with parts broken away.

Referring now more particularly to the drawings, FIG. 1 illustrates a tube bending fixture 10 with a plurality of tube bending tools 12, 14, and 16 mounted on pedestals 18, 20 and 22, respectively. The pedestals, in turn, are mounted on grid plates 24, 26 and 28. The grid plates 24, 26 and 28 are identical, flat, preferably square plates made of metal or other relatively rigid material and secured in edge to edge relationship with other plates 32 of like construction and configuration in a horizontal plane on a support structure 34 to provide a base for the fixture. This arrangement of the plates provides a grid or reference system for accurately locating and positioning the bending tools of the fixture. The number of plates and the size of the support structure 34 can be varied as needed to provided a base of a fixture of any desired size needed to bend any desired length and configuration of a tube.

As previously stated, the tube bending fixture 10 is constructed from a simulation program of tool selection, tool location and bending sequence developed by an experienced toolmaker or fixture designer. Preferably the simulation program is entered into a computer with a suitable computer aided, design program for viewing by a computer operator to insure that the proper tools have been selected and the selected tools are properly located so that they may be operated in the desired sequence, without interference. In the designing of the fixture, different standard tools and bending sequences may have to be tried and adjustments in tool location may have to be made to insure that the tools will bend the tube without interference. When the simulation program is finalized, the computer will output an identification of the standard tools needed and a list of coordinates necessary to establish tool location. In the present instance, it can be assumed that the tools 12, 14 and 16, which are of essentially standard construction, have been selected and located relative to one another in the arrangement shown in FIG. 1 in accordance with a simulation program to bend a rigid metal tube such as a brake line or a fuel line for a motor vehicle into a specific configuration.

Figures 2, 2A:
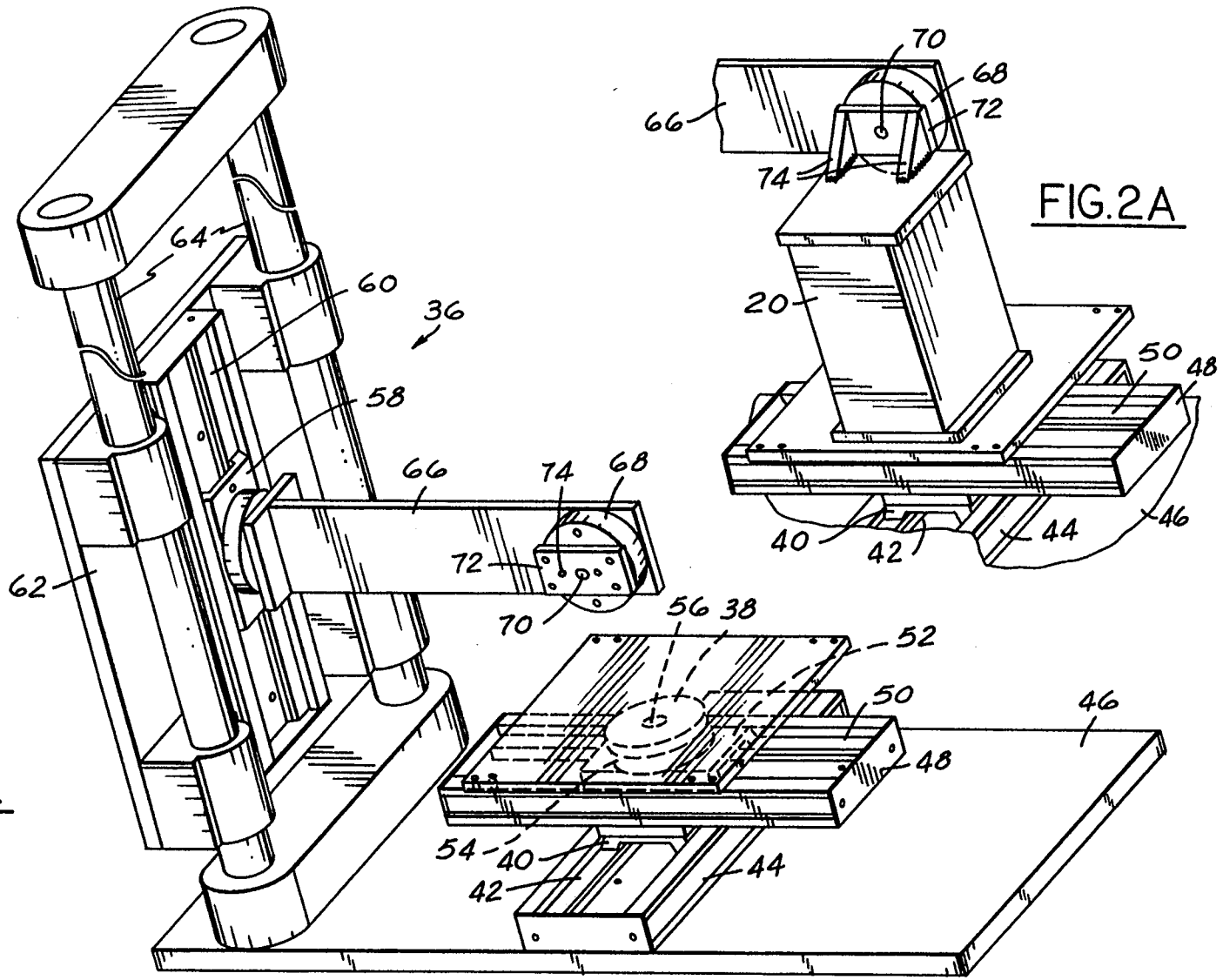
FIG. 2 is a perspective view of a locating device used in the construction of the tube bending fixture shown in FIG. 1.
FIG. 2A is a fragmentary perspective view of a portion of the locating device in FIG. 2, shown being used in the mounting of a pedestal on a grid plate and a tool mounting plate on the pedestal.

FIG. 2 shows a locating device 36 which preferably is employed to construct the tube bending fixture 10. This device locates and orients a tool mounting plate like plate 72 relative to a grid plate like plate 26. The locating device 36 has a platen 38 for supporting one of the grid plates in a horizontal plane, as shown. The platen 38 is supported for lateral and longitudinal movement in the plane of the supported grid plate and for angular movement about an axis through the supported grid plate perpendicular to the plane thereof.

More specifically, there is a first slide 40 mounted for lateral sliding movement in a horizontal plane on the transverse ways 42 of a frame 44 mounted on the base 46. This slide 40 has a frame 48 fixedly mounted on its top surface provided with longitudinal ways 50 extending at right angles to the ways 42. A second slide 52 is mounted on the ways 50 for longitudinal sliding movement in a horizontal plane. A turntable 54 is mounted on the second slide 52. The turntable 54 has a vertical pivot axis 56 perpendicular to the directions of sliding movement of the slides 40 and 52. The platen 38 is supported on the top surface of the turntable 54 for rotation with the turntable about its pivot axis 56.

The locating device 36 also has a third slide 58 movable vertically up and down on the ways 60 carried by the frame 62. Frame 62 is secured in vertically adjusted position on the uprights 64 rigidly secured to and projecting upwardly from the base 46. An elongated horizontal arm 66 is connected at one end to the slide 58 for rotation about the longitudinal axis of the arm 66. A rotatable turntable or disk 68 is mounted on the other end of arm 66 and has a pivot axis 70 perpendicular to arm 66. A tool mounting plate 72 is adapted to be secured to the disk 68 by fasteners 74. Thus, the device 36 is a six axis locating device which has three orthogonal axes for linear movement and three orthogonal axes for rotational movement. This permits a tool mounting plate to be positioned in any desired location and orientation relative to an associated grid plate.

In the tube bending fixture of FIG. 1, each tool is mounted on the top of a pedestal by a mounting plate 72, and each pedestal is mounted on a grid plate. Each tool is precisely located and oriented with respect to its supporting grid plate by use of the coordinates, preferably from the computer, in accordance with the simulation program. These coordinates are used to locate a tool mounting plate on the platen 38 laterally, longitudinally, vertically and angularly. A tool mounting plate 72 is secured to disk 68 and the disk is turned to the proper angle about its own pivot axis 70, the arm 66 is moved vertically to the proper height and turned about its longitudinal axis to the proper angle, all in accordance with the coordinates from the simulation program. A grid plate 26 is secured to the platen 38 and the turntable 54 is turned to the proper angle about its pivot axis 56, the slide 52 is moved longitudinally, and the slide 40 laterally, all in accordance with the coordinates from the simulator program.

Figure 1A:
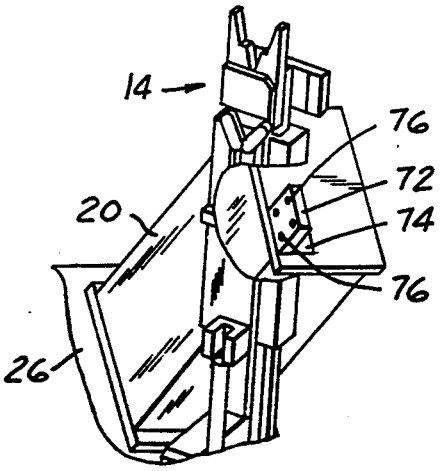
FIG. 1A is a fragmentary perspective view with parts broken away of a portion of FIG. 1, better illustrating the mounting of a standard tube bending tool on a pedestal.

Then a pedestal of the necessary height is selected and placed on the grid plate, its base is secured to the grid plate in proper position, and the tool mounting plate 72 is secured to the top of the pedestal by brackets 74 which are attached to the tool mounting plate and to the pedestal by any suitable means, such as by welding, for example. (See FIGS. 1A and 2A) Typically, the appropriate pedestal can be selected from a group of standard pedestals of different heights and only the brackets are custom made or fabricated for each tool to be mounted. The brackets 74 are fabricated to "bridge the gap" between the standard pedestal and the tool mounting plate 72 so that it can be attached and fixed to the pedestal while held in the desired position by the locating device 36.

Thereafter, the entire subassembly 75 of the grid plate, pedestal and mounting plate is removed from the locating device. Similar subassemblies 77 and 79 are produced for the other tools of the fixture using the locator device and the coordinates from the simulator program. Each subassembly 75, 77 and 79 is then accurately located and mounted in the appropriate grid space or position on the support structure 34 in edge to edge relationship. The grid plate of each subassembly is accurately located on the support structure by locator pins 71 and releasably secured by cap screws 73. Thereafter, the tools 12, 14 and 16 may be mounted on the tool mounting plates 72 by fasteners 76 to complete the tube bending fixture as shown in FIG. 1.

Each of the bending tools 12, 14, and 16 is basically a different style or type of bender which is used in a different range or group of bending applications. By using various combinations of these three types of bending tools an almost infinite variety of tube configurations can be produced. As previously noted, each one of these three types is of a standardized construction. All three types also have several standardized components to minimize manufacturing, service and replacement cost and inventory requirements. Each of these standard tools will now be described in detail.

Referring now to FIGS. 3–7, bending tool 12 has an elongated base 80 with complementary clamp rolls 82 and 84 adjacent one end. Clamp roll 82 is rigidly secured to a stanchion 83 which projects upwardly from the base, and has a flat, circular front face 86. A concave circular recess 88 surrounds the front face 86. Recess 88 is arcuate in cross-section throughout its full circular extent, and extends for 90° from the margin of the front face 86 to the peripheral surface of the clamp roll.

Figure 4:
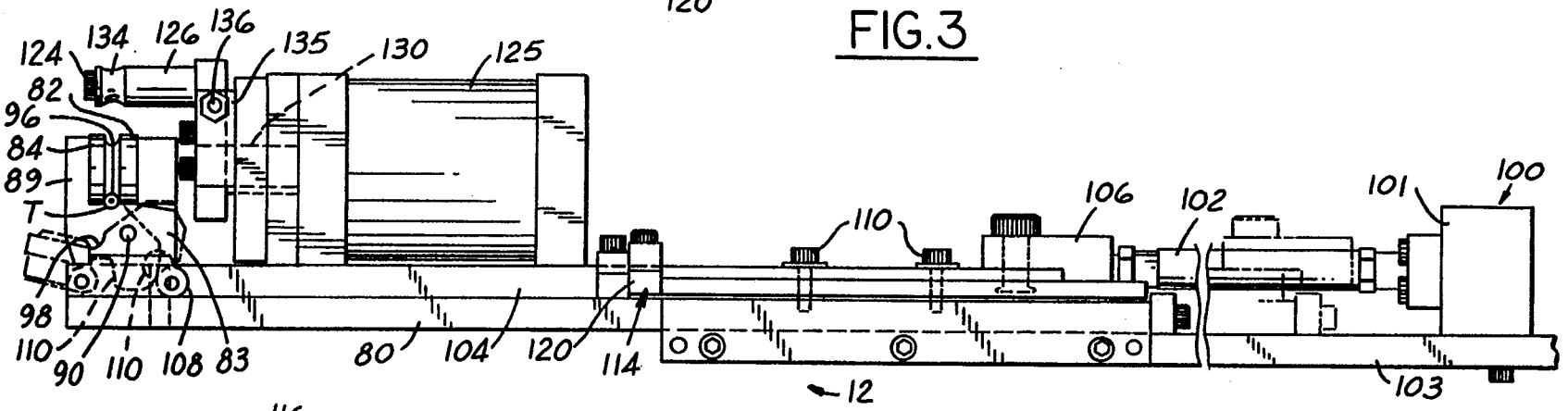
FIG. 4 is a side view of the tube bending tool shown in FIG. 3.
Figure 5:
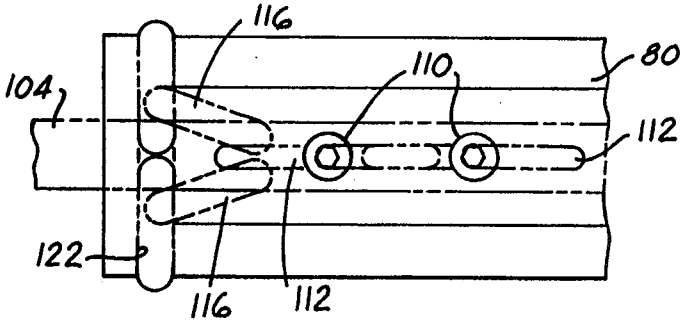
FIG. 5 is a fragmentary diagrammatic view showing the operation of the toggle linkage for locking and unlocking the clamp rolls of the tube bending tool shown in FIGS. 3 and 4.
Figure 7:
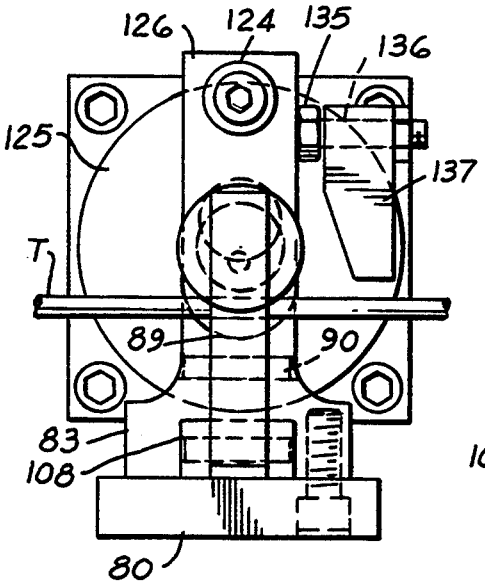
FIG. 7 is an end view of the structure shown in FIG. 6.
Figure 6:
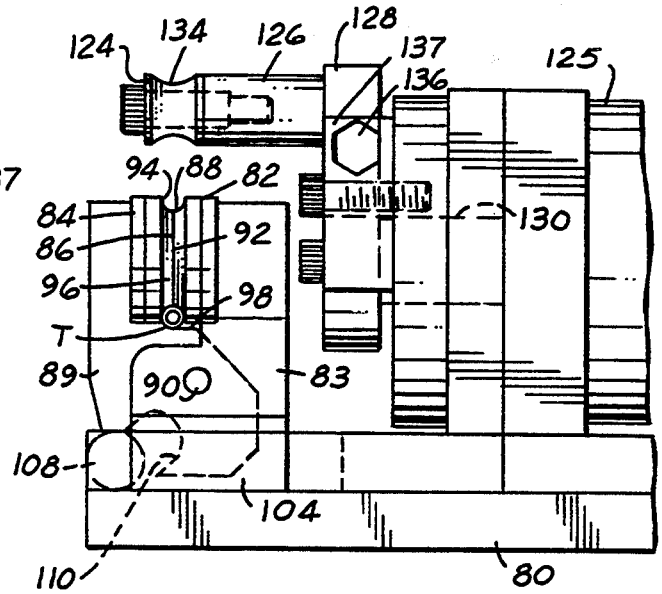
FIG. 6 is an enlarged fragmentary side view of a portion of the tube bending tool of FIGS. 3 and 4.
Figure 8:
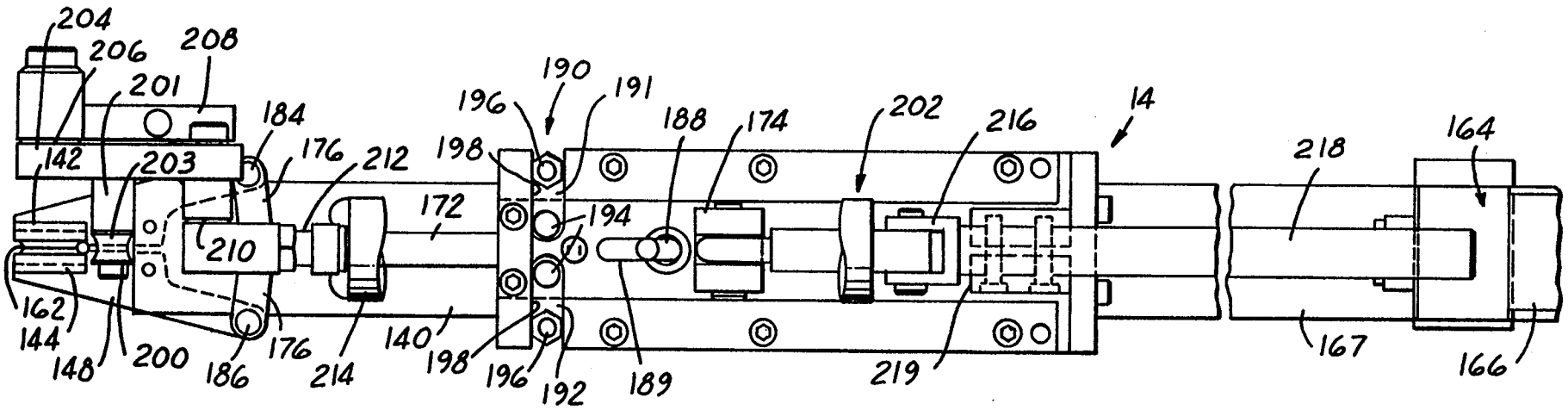
FIG. 8 is a top view of a second tube bending tool used in the fixture of FIG. 1.
Figure 9:
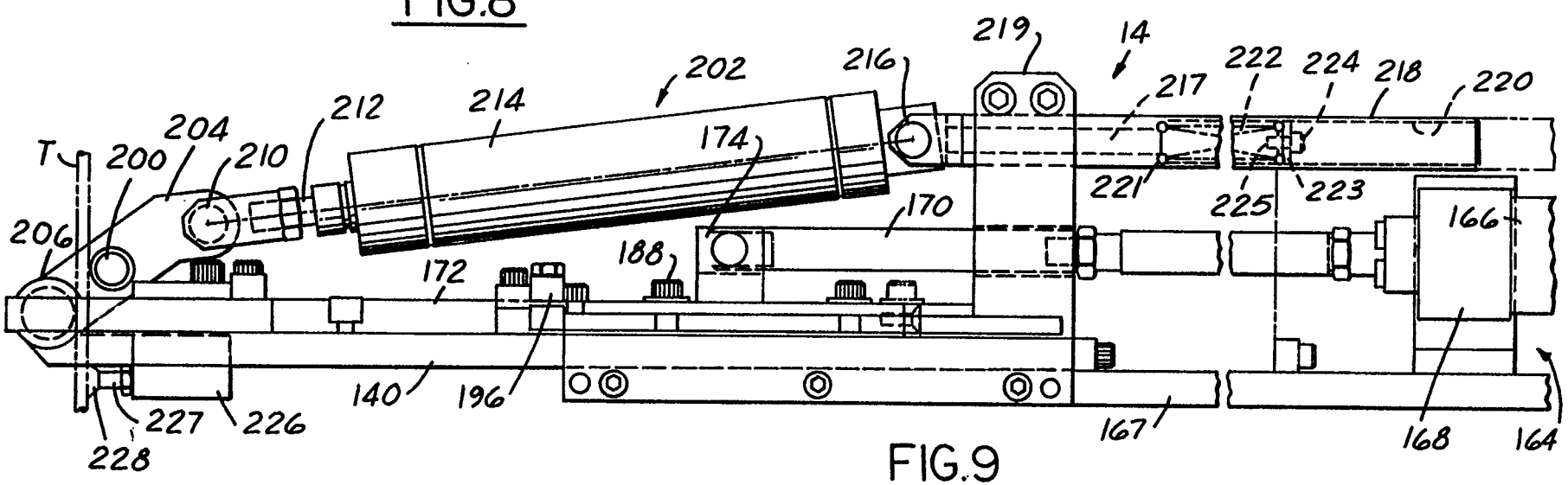
FIG. 9 is a side view of the tube bending tool of FIG. 8.
Figure 10:
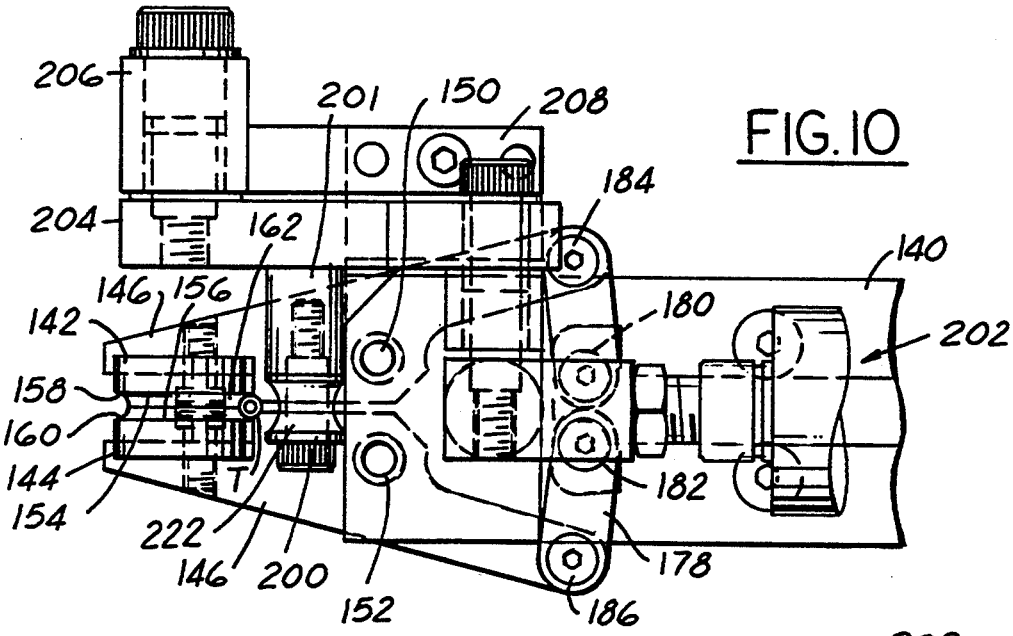
FIG. 10 is an enlargement of a portion of FIG. 8.
Figure 11:
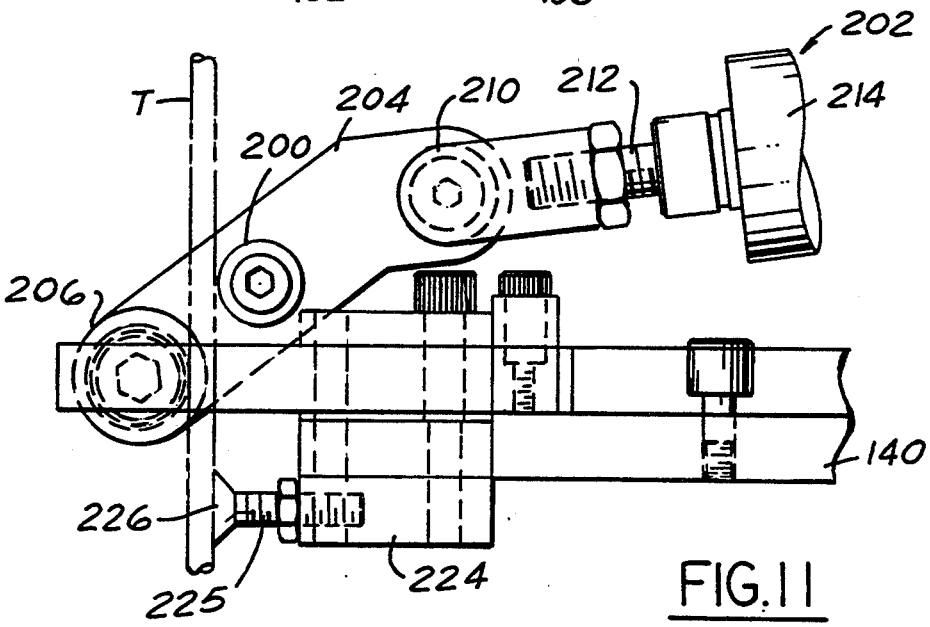
FIG. 11 is an enlargement of a portion of FIG. 9.

Clamp roll 84 is secured to an arm 89 which is pivoted to the stanchion 83 by a transverse pivot shaft 90 for swinging movement from the closed, solid line position shown in FIG. 4 to the open, broken line position. The clamp roll 84 has a flat, circular rear face 92. A concave circular recess 94 surrounds the front face 92. The recess 94 is exactly like recess 88 of clamp roll 82, that is, it is arcuate in cross-section and extends for 90° from the margin of the front face 92 of the peripheral surface of the clamp roll. When the clamp roll 84 is in the closed position, its front face 92 is pressed flush against the front face 86 of clamp roll 82 in abutting contact and the two recesses 88 and 94 together form a radially outwardly opening circular groove 96 which in cross-section is a half-circle, that is, 180° in extent. The diameter of the groove 96 thus formed is the same as the diameter of the tube T to be bent.

The clamp roll 84 has an integral camming surface 98 which lies under the groove 96 in the closed position of the clamp roll to engage and clamp the tube T in the groove, and moves away from the groove in the open position of clamp roll 84 to release the tube T.

A fluid-operated piston-cylinder assembly 100 is provided to move the clamp roll 84 between open and closed positions. Piston-cylinder assembly 100 has a cylinder 101 secured lengthwise upon the top surface of a carrier plate 103 attached to the base 80 adjacent the end thereof opposite the clamp rolls. A piston (not shown) reciprocable within the cylinder has a rod 102 extending therefrom which is bolted to a rod extension 104 by a coupling 106. The rod extension 104 has a roller 108 near one end engageable in a slot 110 in the pivoted clamp roll 84 so that when the piston in cylinder 101 moves in one direction to extend the rod extension 104 clamp roll 84 is pivoted to its closed position, and when the piston moves in the opposite direction to retract rod extension 104 clamp roll 84 is pivoted to its open position (see FIG. 4). Pins 110 are affixed to the base 80 and extend through elongated slots 112 in the rod extension 104 to limit the travel of the rod extension in both directions.

Figure 3:
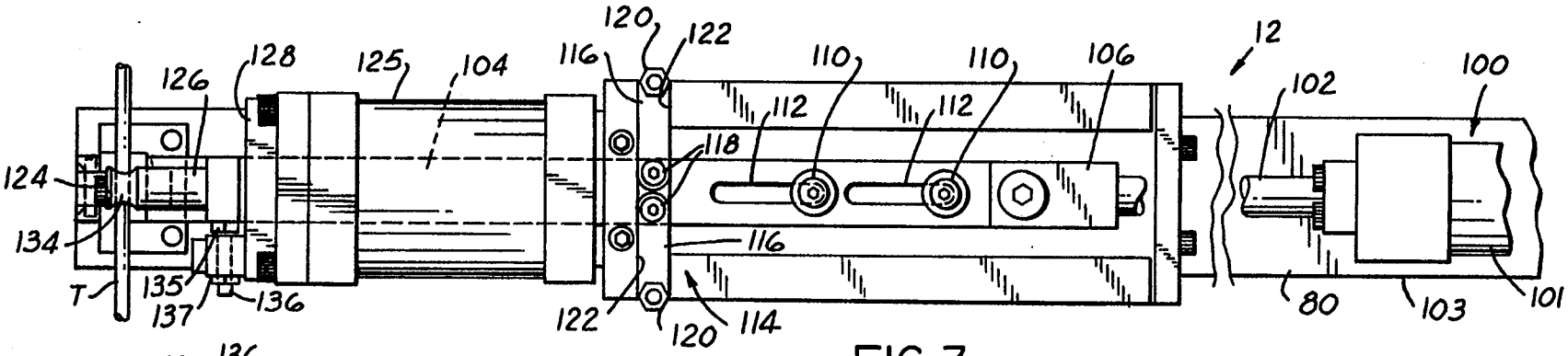
FIG. 3 is a top view a first standard tube bending tool used in the tube bending fixture of FIG. 1.

The rod extension 104 is locked in its extended position in which the clamp rolls 82 and 84 are closed, by toggle linkage 114. The force applied to the closed clamp rolls when bending the tube is resisted by the locked toggle linkage which permits a smaller cylinder 101 producing less force to be used to retain the clamp rolls in their closed position during bending of the tube. The toggle linkage comprises links 116 pivoted at their inner ends to the rod extension 104 by pins 118. Rollers 120 on the outer ends of the links slide and roll in transverse slots 122 in the base. Slots 122 are perpendicular to the rod extension 104. In the extended position of the rod extension 104, links 116 extend perpendicular to the rod extension and are disposed fully in the slots 122, as seen in FIG. 3, locking the rod extension in the extended position. In the retracted position of the rod extension, the links assume the slanted or angled position of FIG. 5.

To bend tube T, the bending tool 12 has a bending roll 124 which is moved in an arc around the clamp rolls 82 and 84 by a reversible rotary motor 125. Bending roll 124 is mounted on a bar 126 carried by a bending arm 128. Bending arm 128 extends radially outwardly from a shaft 130 of the motor 125. Motor 125 is mounted on base 80 with its shaft 130 concentric with the groove 96 formed by clamp rolls 82 and 84. Bar 126 is disposed radially outwardly from and is parallel to motor shaft 130. The bending roll 124 is spaced radially outwardly of groove 96 and has a concave periphery 134. The axis of bending roll 124 is parallel to the axis of the groove 96.

The head 135 of the screw 136 provides an adjustable abutment engageable with the bending arm 128 to limit rotation thereof in one direction. Screw 136 is threaded into a plate 137 rigidly mounted on motor 125. Since the motor 125 is reversible, the tube T can be bent around either side of the clamp rolls and the stop screw 136 and mounting plate 137 are located on the other side.

In use, and with the clamp rolls 82 and 84 open, a tube T is placed in the recess 98 of the movable clamp roll 84 so that it is tangent thereto, as shown in FIGS. 3 and 4. The piston-cylinder assembly 100 is actuated to extend the rod extension 104 and close clamp roll 82 moving camming surface 98 to a position clamping the tube in the groove 96. Then, motor 125 is actuated to turn the bending roll 124 around the clamp rolls and bend the tube. The toggle linkage 114 prevents the bending forces from overpowering the piston-cylinder assembly 100 and opening the clamp rolls 82 and 84. The motor 125 is reversed to disengage and clear the bending roll 124 from the tube. The bent tube is released from the clamp rolls by actuating the piston-cylinder assembly in a direction to retract clamp roll 84 and withdraw the camming surface 98 from clamping engagement with the tube. The arcuate extent of the bend can be varied by adjusting the stop screw 136 which limits the extent of rotary travel of the arm 126 when fully advanced.

Referring now to FIGS. 8–12, the bending tool 14 has an elongate base 140 with complementary clamp rolls 142 and 144 adjacent one end. The clamp rolls 142 and 144 of tool 14 differ from the clamp rolls 82 and 84 of bending tool 12 in that they are turned 90° from the plane of clamp rolls 82 and 84. Clamp rolls 142 and 144 are mounted on movable arms 146 and 148 adjacent the outer ends thereof. The arms 146 and 148 are pivoted intermediate their ends on the laterally spaced apart, parallel pivot pins 150 and 152 which project upwardly from the base. The clamp rolls 142 and 144 have confronting circular faces 154 and 156 surrounded by concave circular recesses 158 and 160. The recesses 158 and 160 are arcuate in cross-section throughout their full circular extent and extend for 90° from the margin of the front face to the peripheral surface of the clamp roll. The arms 146 and 148 are capable of swinging between the closed, solid line position shown in FIG. 12 to the open, broken line position. When the arms are in the closed position, the clamp roll faces 154 and 156 are pressed flush against one another in abutting contact and the two recesses 158 and 160 together form a radially outwardly opening circular groove 162 which in cross-section is a half-circle, that is, 180° in extent. The diameter of the groove 162 thus formed by the recesses is the same as the diameter of the tube T.

A fluid-operated piston-cylinder assembly 164 is provided to pivot the arms 146 and 148, and hence the clamp rolls 142 and 144, between open and closed positions. Piston-cylinder assembly 164 has a cylinder 166 which extends lengthwise of the base and is mounted on a carrier plate 167 secured to the base above the top surface of the plate by a cylinder mount 168. A piston (not shown) reciprocable within the cylinder has a rod 170 extending therefrom which is secured to a rod extension 172 by a coupling 174.

The rod extension 172 is connected to the arms 146 and 148 by links 176 and 178. The links 176 and 178 are pivoted at one end to the rod extension 172 by pivot pins 180 and 182 and are pivoted at their other ends to the ends of the arms 146 and 148 by pivot pins 184 and 186. When the piston in the cylinder 166 is moved in a direction to extend the piston rod 170, the links 176 and 178 swing the arms 146 and 148, and hence the clamp rolls 142 and 144, to the closed position shown in FIGS. 8, 10 and 12. Movement of the piston in the opposite direction to retract the piston rod causes the links 176 and 178 to swing the arms 146 and 148, and hence clamp rolls 142 and 144, to the open position shown in broken lines in FIG. 12. Pins 188 are affixed to the base 140 and extend through elongated slots 189 in the rod extension 172 to limit the travel of the rod extension in both directions.

Figure 12:
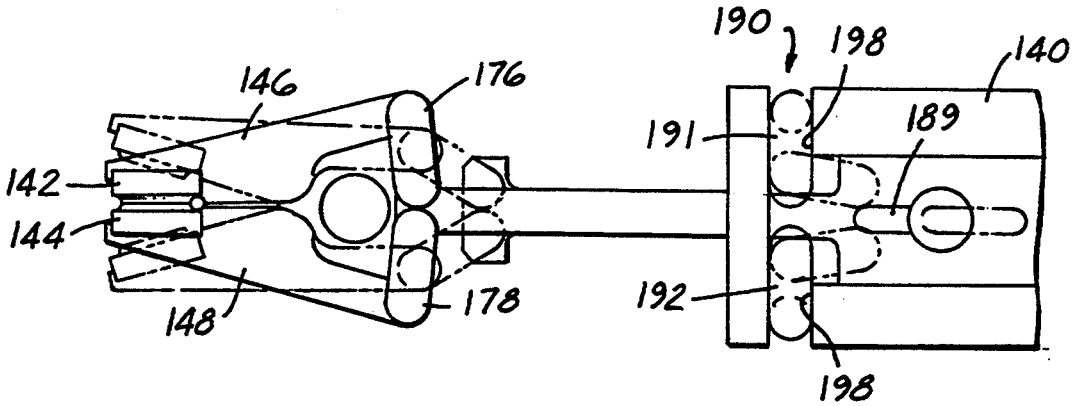
FIG. 12 is a fragmentary diagrammatic view showing the positions of the clamp rolls when open and closed and also showing the toggle linkage for locking the clamp rolls in closed position.

The rod extension 172 is locked in its extended position in which the clamp rolls 142 and 144 are closed, by toggle linkage 190. As previously indicated, the toggle linkage permits the forces produced on the extension rod 172 when bending a tube T to be resisted with a smaller cylinder 166. The toggle linkage comprises links 191 and 192 pivoted at their inner ends to the rod extension 172 by pins 194. Rollers 196 on the outer ends of the links slide and roll in transverse slots 198 in the base. Slots 198 are perpendicular to the rod extension 172. In the extended position of the rod extension 172, links 190 and 192 extend perpendicular to the rod extension and are disposed fully in the slots 198, as seen in FIG. 12, locking the rod extension in the extended position. In the retracted position of the rod extension, the links assume the slanted or somewhat angled position shown in FIG. 12.

The bending tool 14 has a bending roll 200 which is moved in an arc around the clamp rolls 142 and 144 by a piston-cylinder assembly 202 to bend the tube T. Bending roll 200 is carried by a sleeve 201 mounted on a bending arm 204 between the ends thereof. The bending roll 200 is spaced radially outwardly of groove 162 and has a concave periphery 203 and its axis is parallel to the axis of the groove 162. One end of the arm 204 is pivoted at 206 to a plate 208 rigidly mounted on the base 140 for rotation on an axis concentric with the groove 162. The other end of the arm is pivoted by a pin 210 to the rod 212 extending from a piston (not shown) which is reciprocable within the cylinder 214 of the piston-cylinder assembly 202. The cylinder 214 extends lengthwise of the base 140. The end of the cylinder remote from the bending roll is pivoted to a clevis 216 on the end of a rod 217 which is longitudinally slidably supported within a tube 218 that extends lengthwise of the base. The tube 218 is held in longitudinally adjusted position above the base by a clamp 219. Longitudinal adjustment of the tube 218 effects similar longitudinal adjustment of the cylinder 214 to vary the extent of travel of the bending arm 204 and hence the extent of bend of the tube T.

The tube 218 has a counterbore 220 providing an internal shoulder 221. A compression coil spring 222 within the counterbored portion of the tube 218 surrounds the rod 217. One end of the spring bears against the shoulder 221 and the other end bears against an abutment 223 on the end of the rod 217 to hold the clevis 216 abutted against the end of tube 218. The abutment 223 is secured in longitudinally adjusted position in the counterbored portion of the tube 218. A stop screw 224 threads through the abutment 223 and into a socket 225 in the end of the rod 217. Screw 224 is accessible through the open end of tube 218. By turning the screw, the rod 217 may be longitudinally adjusted in small increments, providing equally small increments of adjustment of the rod 217 and cylinder 214, making it possible to fine tune the adjustment in the extent of travel of the bending arm 204.

A plate 226 rigidly mounted on the base 140 has a screw 227 threaded thereto. The head 228 of the screw provides an adjustable abutment engageable with the clamped tube while the tube is being bent.

In use, and with the clamp rolls 142 and 144 open, a tube T is placed between the rolls and bearing on the stop screw 227 so that it is tangent to the recesses 158 and 160 of one of the clamp rolls when closed. The piston-cylinder assembly 164 is actuated to extend the rod extension 172 and close the clamp rolls forming the groove 162 and with the tube T in the groove. Then, piston-cylinder assembly 2Q2 is actuated to turn the bending roll 200 around the clamp rolls and bend the tube. The arcuate extent of the bend can be varied by the adjustments previously described to limit the extent of the travel of arm 204 when the rod 212 of the cylinder 214 is fully extended. The toggle linkage 190 prevents the bending forces from overpowering the piston-cylinder assembly 202 and opening the clamp rolls 142 and 144. After bending, the tube is released by actuating the piston-cylinder 202 in a direction to retract the clamp rolls.

Figure 13:
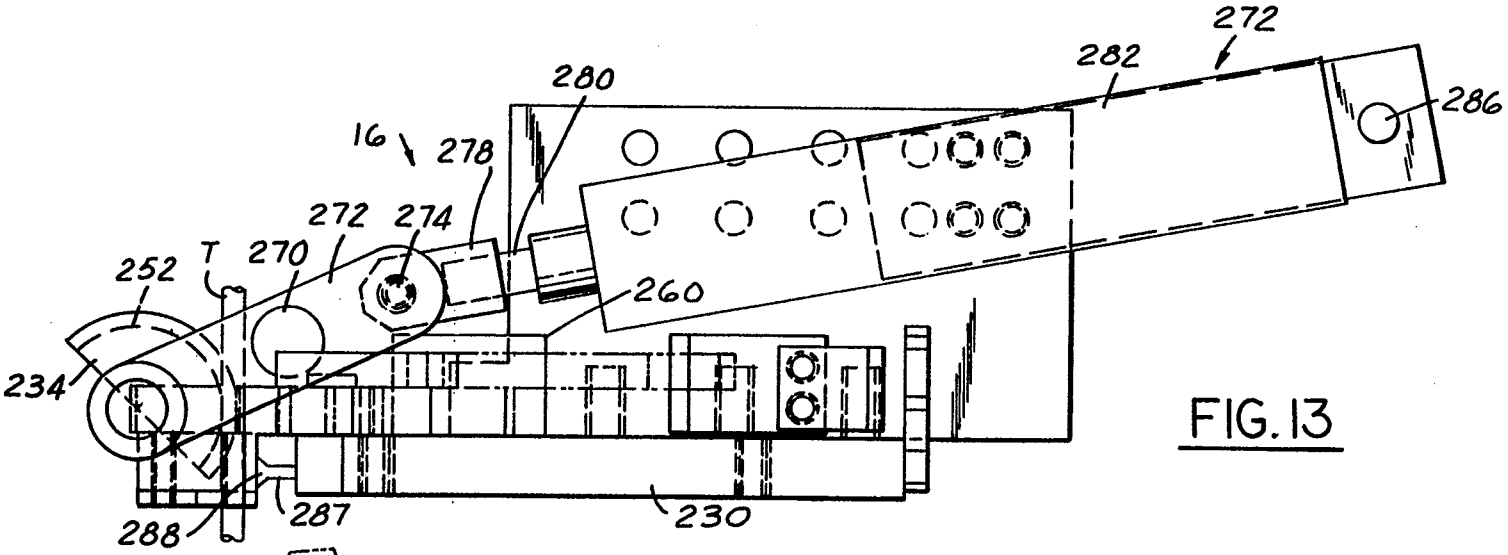
FIG. 13 is a side view of a third tube bending tool used in the fixture of FIG. 1.
Figure 14:
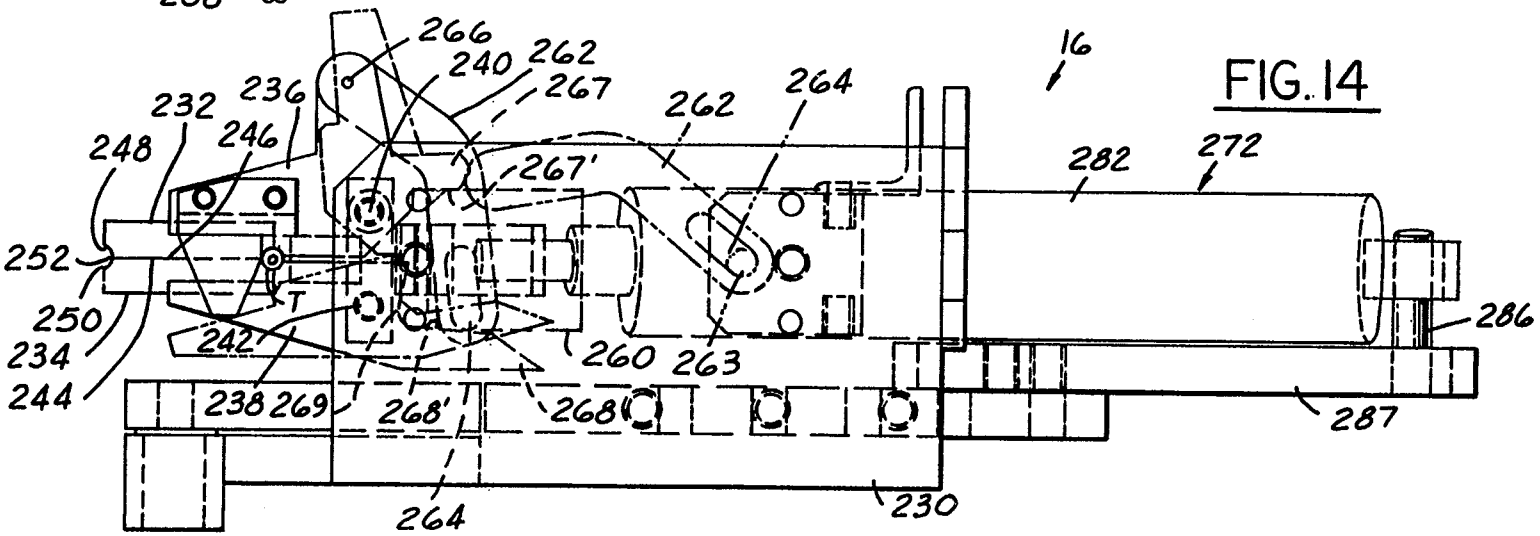
FIG. 14 is a top view of the tube bending tool shown in FIG. 13.

Referring to FIGS. 13 and 14, the bending tool 16 has an elongate base 230 with complementary clamp rolls 232 and 234 adjacent one end. The clamp rolls 232 and 234 of tool 16 differ from the clamp rolls 142 and 144 of bending tool 14 primarily in that they are half rolls, that is they are only 180° in extent. Clamp rolls 232 and 234 are mounted on the outer end portions of movable arms 236 and 238, respectively. The arms 236 and 238 are pivoted intermediate their ends on laterally spaced apart, parallel pivot pins 240 and 242 which project upwardly from the base 230. The clamp rolls have confronting circular faces 244 and 246 surrounded by concave arcuate recesses 248 and 250. The recesses 248 and 250 are arcuate in cross-section throughout their full half-circle extent and extend for 90° from the margin of the front face to the peripheral surface of the clamp roll. The arms 236 and 238 are capable of swinging between the closed, solid line position shown in FIG. 14 to the open, broken line position thereof. When the arms are in the closed position, the clamp roll faces 244 and 246 are pressed flush against one another in abutting contact and the two recesses 248 and 250 together form a radially outwardly opening semi-circular groove 252 which in cross-section is a half-circle, that is, 180° in extent. The diameter of the groove 252 thus formed by the recesses is the same as the diameter of the tube T.

A fluid operated piston-cylinder assembly 254 is provided to pivot the arms 236 and 238, and hence the clamp rolls 232 and 234, between open and closed positions. Piston-cylinder assembly 254 is shown in FIG. 1, but for clarity it has been omitted from FIGS. 13 and 14. Piston-cylinder assembly 254 has a cylinder 256 which extends lengthwise of the base 230 and is secured to the top surface of a mounting plate 257 secured to the base. A piston (not shown) reciprocates within the cylinder and has a rod 258 provided on the end with a block or wedge 260. The rod 258 also has a clevis 259 which is pivotally connected to one end of a link 262 by a pivot pin 263 extending between the arms of the clevis and through an elongate slot 264 in the link. The other end of the link is pivotally connected at 266 to one of the arms 236. On the ends opposite clamp rolls 232 and 234, arm 236 has an extension 267 and arm 238 has an extension 268.

When the piston in cylinder 256 is moved in a direction to extend the piston rod 258, the wedge moves between arm extensions 267 and 268, engaging the opposing surfaces 267' and 268', to cam the arms 236 and 238 to the closed position shown in FIG. 14. During this time, the link 262 is moved to the solid line position of FIG. 14. When the piston in cylinder 256 is moved in the opposite direction to retract the piston rod 258, the wedge is initially withdrawn from the space between the arm extensions 267 and 268. During such initial movement, the link will be turned about the point 266 of its pivotal connection to arm 236 while pin 263 will simply move to one end of the slot 264. Then as the piston continues its retraction, the lost motion between pin 263 and slot 264 will be taken up and the link 262 will be moved to the phanton line position of FIG. 14. In the process, the clamp arm 236 will be turned to its open position. During the latter stages in the opening of clamp arm 236, its extension 267 will engage surface 269 of clamp arm 238 and pivot the latter to its open position.

The bending tool 16 has a bending roll 270 which is moved in a arc around the clamp rolls 232 and 234 by a piston-cylinder assembly 272 to bend the tube T. Bending roll 270 is mounted on a bending arm 274 between the ends thereof. One end of the bending arm 274 is pivoted to the base 230 for swinging movement on a axis coinciding with the center of the groove 252 defined by the clamp rolls. The other end of the arm is pivoted by a pin 276 to a clevis 278 on the rod 280 extending from a piston (not shown) which is reciprocable within the cylinder 282 of the piston-cylinder assembly 272. The cylinder 282 extends generally lengthwise of the base 230 and has a pivot pin 286 on the end remote from the bending rolls for pivotal engagement with a support 287 mounted on and rigid with the base. The bending roll 270 is spaced radially outwardly of the groove 252 and has a concave periphery 286. The axis of the bending roll 270 is parallel to the axis of the groove 252. A screw 287 threaded into the base 230 adjacent to the bending rolls has a head 288 which provides an adjustable abutment engageable with the tube while the tube is being bent.

The tube bending tool 16 differs from the bending tools previously described in that the arm 236 carrying the clamp roll 232 moves from its closed position to its open position through an angle of approximately 85°, whereas the arm 238 on which clamp roll 234 is mounted moves from closed to open position through an arc of only approximately 15°. Thus the rolls when open facilitate side loading of a tube to be bent.

In use, and with the clamp rolls 232 and 234 in the open dotted line position of FIG. 14, a tube T is placed in the recess of one of the clamp rolls, preferably roll 234, in a position such that the tube is tangent thereto. The piston-cylinder assembly 254 is then actuated to extend the piston rod 258, moving the clamp rolls 232 and 234 to their closed positions. Then, with the tube disposed in the groove 252 provided by the recesses of the closed clamp rolls, and engaged against the abutment provided by the head 288 of the screw 287, piston-cylinder assembly 272 is actuated to turn the bending roll around the clamp rolls and bend the tube. The arcuate extent of the bend can be varied by adjusting the extent to which the arm 272 is rotated to its fully advanced position by the cylinder 282. This can be accomplished by shifting longitudinally the position at which the mounting bracket 287 is secured to the base 230. After bending, the tube is released by actuating the piston-cylinder assembly 254 in a direction to retract the clamp rolls.

What is claimed is:

1. A tube bending fixture, comprising a plurality of standardized tube bending tools, a separate pedestal for each of said standardized tube bending tools, a separate standardized grid plate for each of said pedestals and having locators thereon, said grid plates being flat, generally rectangular and substantially identical in thickness, perimeter and position of said locators thereon, a rigid grid plate support for all of said grid plates, complementary locators on said grid plate support engagable with said locators on said grid plates for accurately locating a plurality of grid plates thereon in a predetermined fixed grid relative to three orthogonal axes with uniform spacing between said complementary locators, for each tube bending tool a separate sub-assembly of a tool mounting plate, a pedestal, and one of said grid plates which sub-assembly was prefabricated remote from said grid support with an adjustable locating fixture having adjustable means locating such one grid plate and such tool mounting plate in a predetermined position relative to such three orthogonal axes and said complementary locators while they are being rigidly secured to such pedestal disposed between them to produce a rigid sub-assembly for mounting a tube bending tool on said rigid grid plate support in a predetermined position relative to such three orthogonal axes and said complementary locators on said grid plate support, means mounting each said tube bending tool on its respective sub-assembly in a predetermined position relative to such three orthogonal axes, and means releasably mounting each said sub-assembly with its grid plate on said grid plate support with its locators engaging some of the complementary locators on said support to secure such grid plate in a plane parallel to two of such orthogonal axes and in a grid accurately locating its grid plate relative to such two orthogonal axes in a predetermined location and arrangement for the sequential operation of said standardized tube bending tools in a tube to bend the tube to a predetermined configuration.

2. A tube bending fixture as defined in claim 1, wherein for at least one sub-assembly its pedestal is of a standardized height and its tool mounting plate is secured on its associated pedestal in a predetermined position.

3. A tube bending fixture as defined in claim 1, wherein said grid plates are square and arranged on said grid plate support in edge to edge relationship.

4. A tube bending fixture as defined in claim 1, wherein said grid plates are square and arranged on said grid plate support with additional like grid plates in edge to edge relationship.

5. A tube bending fixture, comprising a plurality of standardized tube bending tools, a separate pedestal for each of said standardized tube bending tools, a separate standardized grid plate for each of said pedestals and having locators thereon, said grid plates being flat, generally rectangular and substantially identical in thickness, perimeter and position of said locators thereon, a rigid grid plate support for all of said grid plates, complementary locators fixed on said grid plates for accurately locating a plurality of grid plates thereon in a predetermined grid fixed relative to three orthogonal axes with uniform spacing between said complementary locators, for each tube bending tool a separate sub-assembly of a tool mounting plate, a pedestal, and one of said grid plates which sub-assembly was prefabricated remote from said grid support with such one grid plate and such tool mounting plate in a predetermined position fixed relative to such three orthogonal axes and said complementary locators on said grid plate support and rigidly secured to such pedestal disposed between them to produce a rigid sub-assembly for mounting a tube bending tool on said rigid grid plate support in a predetermined position relative to such three orthogonal axes and said complementary locators on said grid plate, means mounting each said tube bending tool on its associated mounting plate of its respective sub-assembly in a predetermined position relative to such three orthogonal axes, and means releasably mounting each said sub-assembly with its grid plate on said grid plate support with its locators engaging some of the complementary locators on said support to secure such grid plate in a plane parallel to two of such orthogonal axes and in a grid accurately locating its grid plate relative to such two orthogonal axes in a predetermined location and arrangement for the sequential operation of said standardized tube bending tools on a tube to bend the tube to a predetermined configuration.

6. A tube bending fixture as defined in claim 5, wherein said grid plates are square and arranged on said grid plate support in edge to edge relationship.

7. A tube bending fixture as defined in claim 5, wherein said grid plates are square and arranged on said grid plate support with additional like grid plates in edge to edge relationship.

8. A method of building a tube bending fixture, comprising the steps of providing a plurality of standardized tube bending tools, providing a pedestal for each tube bending tool, providing a separate grid plate for each pedestal, said grid plates being flat, generally rectangular and substantially identical in thickness and perimeter, providing a rigid support for all of the grid plates, for each tube bending tool a separate sub-assembly of a tool mounting plate, a pedestal, and one of said grid plates which sub-assembly is made remote from said grid support using an adjustable locating fixture having means for locating such one grid plate and such tool mounting plate in a predetermined position relative to three orthogonal axes while securing them to such pedestal disposed between them to produce a rigid sub-assembly for mounting a tube bending tool on said rigid grid plate support in a predetermined position relative to such three orthogonal axes, and thereafter mounting each such sub-assembly with its grid plate on said grid plate support with its grid plate in a plane parallel to two of such orthogonal axes and in a grid accurately locating its grid plate in a predetermined location relative to such two orthogonal axes so that all of said bending tools when received on their respective mounting plates are in predetermined locations relative to said three orthogonal axes and in an arrangement for the sequential operation of said tube bending tools on a tube to bend the tube to a predetermined configuration.

9. A method as defined in claim 8, wherein said tube bending tools are mounted as aforesaid on said respective pedestals by providing a tool mounting plate for each of said pedestals, securing said tool mounting plates on said respective pedestals in predetermined positions, and mounting said tube bending tools on said respective tool mounting plates in predetermined positions.

10. A method as defined in claim 8, wherein said grid plates are rectangular, and including the steps of arranging said grid plates in edge to edge relationship.

11. A method as defined in claim 8, including the steps of designing a simulation program of tool selection, tool location and bending sequence, and building said tube bending fixture in accordance with said program.

12. A method as defined in claim 11, including entering said simulation program into a computer for viewing by a computer operator to verify tool selection, tool location and bending sequence without interference.

13. A method as defined in claims 8, including the steps of designing a simulation program of coordinates for locating said grid plates and tool mounting plates relative to each other, and relatively locating said grid plates and tool mounting plates in accordance with said program.

14. A method as defined in claim 11, including making said simulation utilizing a computer and a computer program to verify tube bending tool selection, tube bending tool location and bending sequence without interference.

15. A method of building a tube bending fixture, comprising the steps of providing a plurality of standardized tube bending tools, providing a pedestal for each tube bending tool, providing a separate grid plate for each pedestal, said grid plates being flat, generally rectangular and substantially identical in thickness and perimeter, providing a rigid support for all of the grid plates, providing a bending tool mounting plate for each of said standardized tube bending tools, mounting each said mounting plate on a separate one of said pedestals and each such pedestal on a separate one of said grid plates in a predetermined position relative to three orthogonal axes by using a locating fixture having means for locating one of said grid plates in a predetermined position relative to such orthogonal axes and means for locating one of said tool mounting plates in a predetermined position relative to such orthogonal axes by securing one of said pedestals to such one said grid plate and such one tool mounting plate while the latter are located by such fixture as aforesaid, and thereafter mounting each such grid plate on said grid plate support in a plane parallel to two of such orthogonal axes and in a grid accurately locating each such grid plate in a predetermined location relative to such two orthogonal axes so that all of said bending tools when received on their respective mounting plates are in a predetermined location relative to said three orthogonal axes and in an arrangement for the sequential operation of said tube bending tools on a tube to bend the tube to a predetermined configuration.

16. Apparatus as defined in claim 15, wherein said means for locating one of said grid plates comprises a platen for supporting one of said grid plates, and means mounting said platen for lateral and longitudinal movement in the plane of a supported grid plate and for angular movement about an axis through the supported grid plate perpendicular to the plane thereof.

17. Apparatus as defined in claim 16, wherein said mounting means for said platen comprises a first slide mounted for lateral sliding movement, a second slide mounted on said first slide for longitudinal sliding movement, a turntable mounted on said second slide having a pivot axis perpendicular to the directions of sliding movement of said slides, and means mounting said platen on said turntable.

18. Apparatus as defined in claim 17, wherein said means for locating one of said tool mounting plates comprises a third slide mounted for sliding movement along a path perpendicular to the plane of a grid plate supported on said platen, an arm perpendicular to the path of said third slide and connected at one end to said third slide for axial rotation, a second turntable on the other end of said arm rotatable on an axis perpendicular to said arm, and means for attaching one of said tool mounting plates to said second turntable.

19. A method as defined in claim 15, wherein said tube bending tools are mounted on said respective pedestals by providing a bracket for each of said pedestals, securing each said tool mounting plate by at least one bracket to its said respective pedestal in a predetermined position relative to such orthogonal axes, and releasably mounting said tube bending tools on said respective tool mounting plates in predetermined positions.

20. A method as defined in claim 15, including the step of arranging said grid plates in generally edge to edge relationship.

21. A method as defined in claim 15, including the steps of making a simulation of tube bending tool selection, tube bending tool location relative to such orthogonal axes and bending sequence, and building said tube bending fixture in accordance with said simulation.

22. A method as defined in claim 21, including making said simulation utilizing a computer and a computer program to verify tube bending tool selection, tube bending tool location and bending sequence without interference.

* * * * *